US005713171A

United States Patent [19]

Andres

[11] Patent Number: 5,713,171

[45] Date of Patent: Feb. 3, 1998

[54] DECK RAILING ASSEMBLY AND AN ASSOCIATED METHOD

[75] Inventor: Thomas J. Andres, North Versailles, Pa.

[73] Assignee: Thermal Industries, Inc., Pittsburgh, Pa.

[21] Appl. No.: 825,656

[22] Filed: Apr. 3, 1997

Related U.S. Application Data

[63] Continuation of Ser. No. 585,631, Jan. 16, 1996, abandoned.

[51] Int. Cl.[6] ..... E04B 1/00

[52] U.S. Cl. ..... 52/263; 256/19; 256/59; 256/65

[58] Field of Search ..... 256/19, 65, 59, 256/21, 22, 66, DIG. 1, DIG. 6, 24, 1; 52/79.6, 650.3, 263

[56] References Cited

U.S. PATENT DOCUMENTS

| | | | |
|---|---|---|---|
| 2,771,276 | 11/1956 | Constance, Jr. et al. | 256/22 |
| 3,083,951 | 4/1963 | Huret | 256/65 |
| 3,620,027 | 11/1971 | Nordell . | |
| 3,815,550 | 6/1974 | Becker . | |
| 3,822,053 | 7/1974 | Daily | 256/65 X |
| 3,914,913 | 10/1975 | Roberts . | |
| 3,918,686 | 11/1975 | Knott et al. | 256/22 X |
| 3,942,763 | 3/1976 | Helterbrand et al. | 256/22 |
| 3,959,830 | 6/1976 | va den Broek . | |
| 4,007,919 | 2/1977 | Totten | 256/59 |
| 4,014,520 | 3/1977 | Walters | 256/59 X |
| 4,027,855 | 6/1977 | Lauzier | 256/59 X |
| 4,058,942 | 11/1977 | Naka . | |
| 4,078,515 | 3/1978 | Svirklys . | |
| 4,135,339 | 1/1979 | Pawlitschek . | |
| 4,266,381 | 5/1981 | Deller . | |
| 4,289,302 | 9/1981 | Montgomery | 256/19 |
| 4,436,274 | 3/1984 | Kramer . | |
| 4,722,514 | 2/1988 | Pettit | 256/19 X |
| 4,823,529 | 4/1989 | Canfield et al. | 52/263 |
| 4,840,824 | 6/1989 | Davis . | |
| 4,905,431 | 3/1990 | Davis . | |
| 4,907,387 | 3/1990 | Turnbull . | |
| 4,947,595 | 8/1990 | Douds . | |
| 5,009,045 | 4/1991 | Yoder . | |
| 5,048,448 | 9/1991 | Yoder . | |
| 5,070,664 | 12/1991 | Groh . | |
| 5,103,614 | 4/1992 | Kawaguchi . | |
| 5,312,089 | 5/1994 | Venegas, Jr. | 256/89 X |
| 5,313,756 | 5/1994 | Ways et al. | 52/263 |
| 5,480,126 | 1/1996 | Teasdale | 256/19 |
| 5,617,697 | 4/1997 | Erwin | 52/79.6 X |

FOREIGN PATENT DOCUMENTS

| | | | |
|---|---|---|---|
| 8400058 | 8/1985 | Netherlands | 256/24 |

*Primary Examiner*—Harry C. Kim

*Attorney, Agent, or Firm*—David V. Radack; Eckert Seamans Cherin & Mellott, LLC

[57] ABSTRACT

A railing assembly for use in association with a deck having a deck surface, the deck including at least one post extending vertically upwardly from the deck surface. The railing assembly includes at least one plastic post cover for covering the post and at least one plastic rail extending from the plastic post cover. The invention further can include a fastener for securing the rail to the post and the post cover. The invention also can include a unique picket assembly, the pickets of the picket assembly being generally vertically oriented and spaced from and secured to the plastic rail. A method of assembling a railing assembly for a deck having a deck surface is also provided.

17 Claims, 11 Drawing Sheets

DECK RAILING ASSEMBLY AND AN ASSOCIATED METHOD

This is a File Wrapper continuation of application Ser. No. 08/585,631, filed Jan. 16, 1996, now abandoned.

BACKGROUND OF THE INVENTION

This invention relates to a deck railing assembly and an associated method and more particularly to a deck railing assembly including plastic post covers for covering a wooden post extending from the deck surface and plastic railings extending between and secured to the plastic post covers and the underlying posts.

Plastic extrusions are being used more frequently to replace wood in the construction of decks for homes and boat docks, for example. Plastic extrusions do not rot like wood, do not require that a protectant, such as sealant, be applied thereto and can be easily cleaned and maintained. My copending U.S. patent application Ser. No. 08/397,002 filed Mar. 1, 1995, discloses a plastic extrusion for use in floor assemblies as well as a floor assembly consisting of the plastic extrusion and a plastic snap connector. A method of assembling a deck is also disclosed.

What is needed, in addition to the flooring assembly, is a railing assembly that is also made of plastic. The railing assembly should be easy to install and should also meet building codes for safety.

SUMMARY OF THE INVENTION

The invention has met or exceeded the above mentioned needs as well as others. The railing assembly for use in association with a deck having a deck surface, the deck including at least one post extending vertically upwardly from the deck surface, includes at least one plastic post cover for covering the post and at least one plastic rail extending from the plastic post cover. The invention further can include fastening means for securing the rail to the post and the post cover. The invention also can include a unique picket assembly, the pickets of the picket assembly being generally vertically oriented and spaced from and secured to the plastic rail.

A method of assembling a railing assembly for a deck having a deck surface is also disclosed. The method includes providing a post extending from the deck surface and also providing at least one plastic post cover and at least one plastic rail. The method then comprises covering the post with a plastic post cover and securing the plastic rail to the post and post cover to form the railing assembly.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
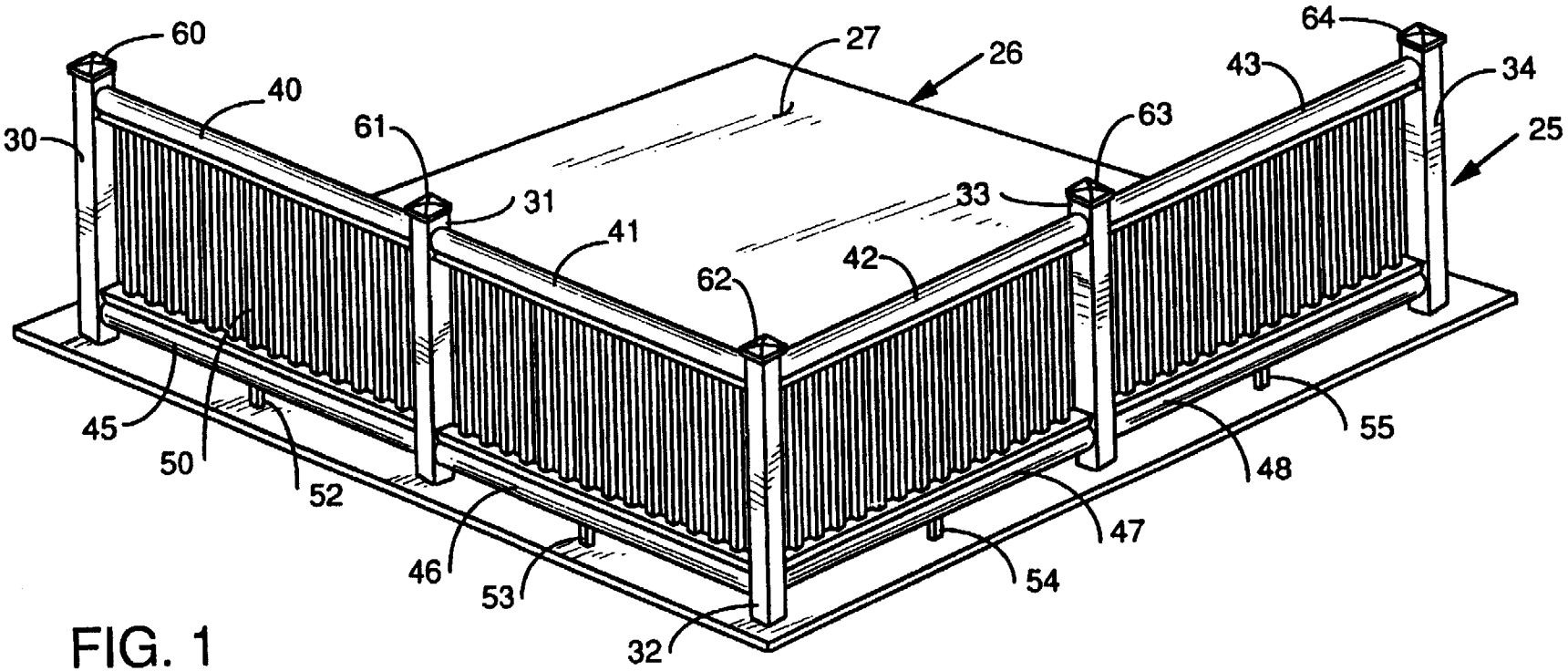
FIG. 1 is a perspective view of a deck showing the deck railing assembly installed thereon.

Referring now more particularly to FIG. 1, a railing assembly 25 is shown installed on a deck 26 having a deck surface 27. The deck surface 27 can be made in accordance with the teachings in my U.S. patent application Ser. No. 08/397,002 filed Mar. 1, 1995, the disclosure of which is expressly incorporated by reference herein.

The railing assembly 25 consists of a plurality (five are shown in FIG. 1) of post covers 30, 31, 32, 33, 34 which are covering the wooden posts (not shown) which extend generally perpendicularly from the deck surface 27. Post covers 30 and 34 are end post covers, whereas post covers 31 and 33 are in-line post covers and post cover 32 is a corner post cover. Extending between the post covers are a series of upper rails 40, 41, 42 and 43 and a series of lower rails 45, 46, 47 and 48. The railing assembly 20 further consists of a plurality of pickets, such as picket 50 which is spaced from and substantially parallel to the post covers, such as post covers 30 and 31, and which is secured both to the upper rail, such as upper rail 40, and lower rail, such as lower rail 45. The railing assembly 20 also includes center supports 52, 53, 54 and 55 which are secured to respective lower rails 45, 46, 47 and 48 and the deck surface 27. The center supports 52–55 are usually needed if the distance between adjacent posts is greater than five feet. Finally, the railing assembly includes top post covers 60, 61, 62, 63 and 64 for covering the top of each respective post cover 30–34.

It will be appreciated that all components described above are made of plastic and more preferably are plastic extrusions, however, the post covers could be injected molded. The plastic to be extruded is preferably either virgin or recycled polyvinyl chloride ("PVC") material. The plastic extrusions never need painting, do not rust (like metal railings) and cannot rot (like wood railings). In short, the rail assembly 25, once installed, does not require any regular continuing maintenance and potentially has an unlimited useful life.

Figure 2:
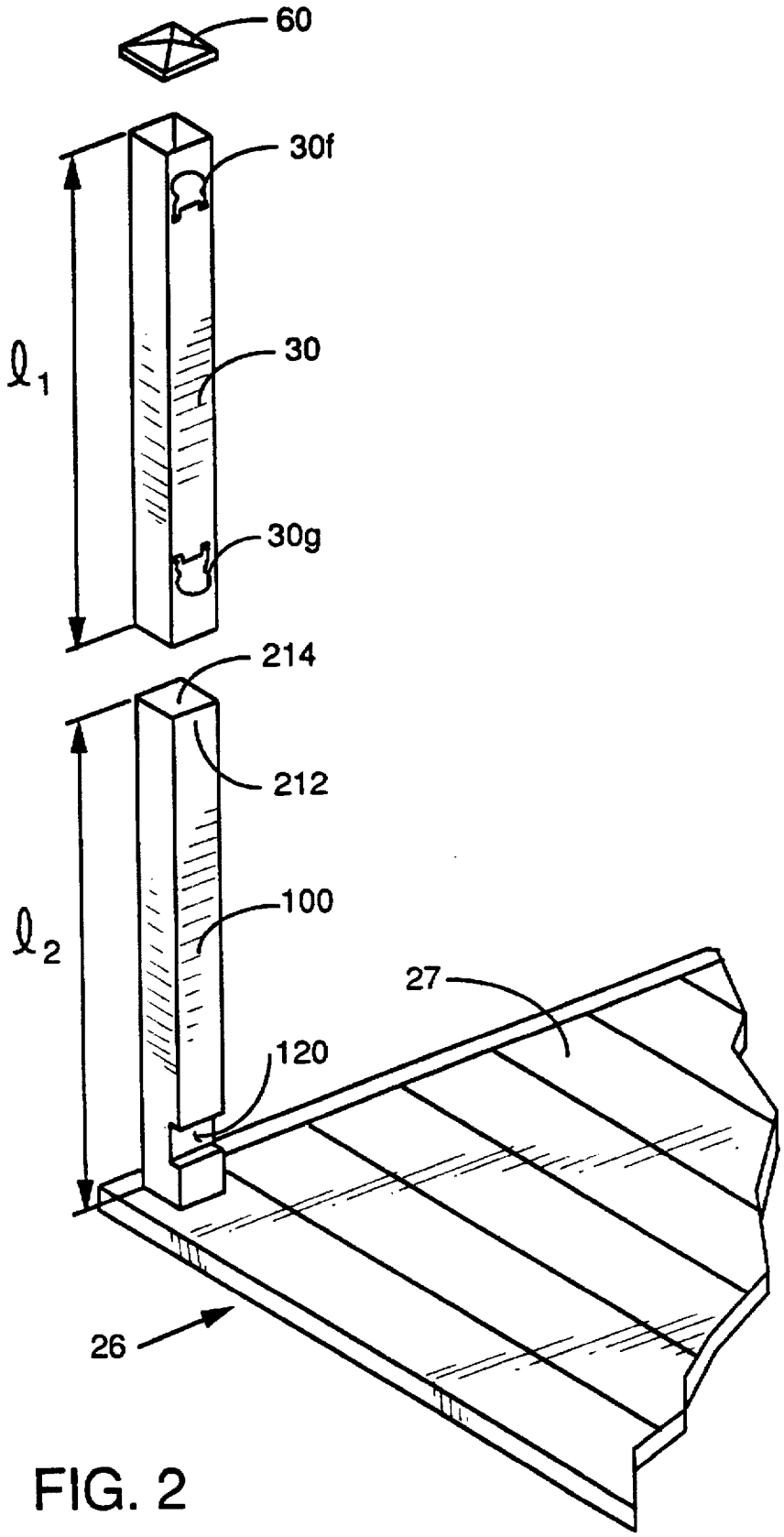
FIG. 2 is a partial perspective view showing the installation of an end post cover onto a wooden post of the deck.
Figure 3:
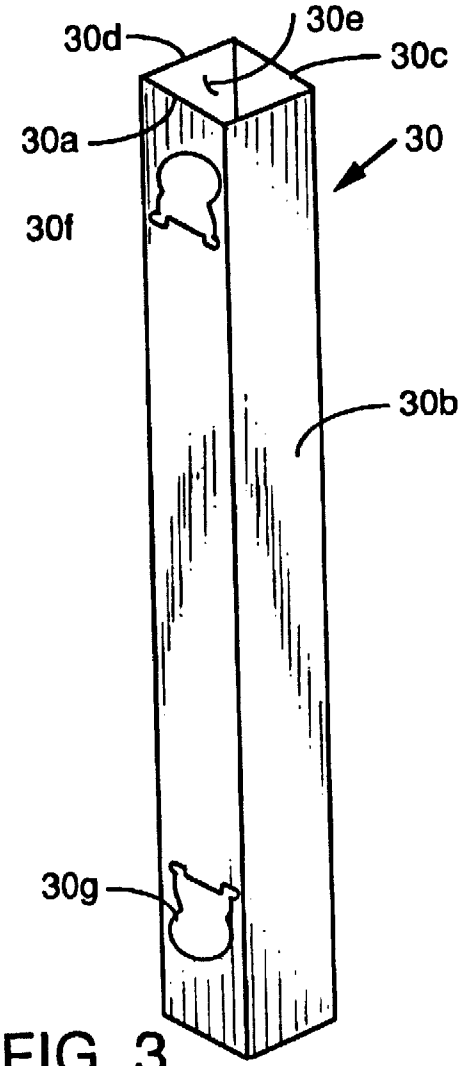
FIG. 3 is a perspective view of an end post cover.

Referring now to FIG. 2, the installation of the railing assembly will be explained in detail. FIG. 2 shows a wooden post 100 that extends from the deck surface 27. The wooden post 100 is a standard four-by-four that is used to frame the deck 26 and which, in the prior art, was left exposed to the elements as part of the railing assembly. The wooden post 100, if left exposed to the elements and untreated would very quickly rot and need to be replaced. Of course, protectants can be applied to the wooden post, but this is a time consuming project and requires added expense and diligence in reapplying the protectant year after year. In accordance with the invention, a plastic post cover, such as end post cover 30 is provided which is basically a hollow square tube that is adapted to cover the wooden post 100. The end post cover 30, which can be seen in more detail in FIG. 3 has four walls 30*a*, 30*b*, 30*c* and 30*d* which form a square, hollow tube. The opening 30*e* defined by the walls 30*a*–30*d* is sized so as to cover the wooden post. Wall 30*a* includes two railing holes 30*f* and 30*g* for facilitating securement of upper rail 40 and lower rail 45 to the wooden post 100 and end post cover 30 as will be explained below. In accordance with the invention, the length $l_1$, of the end post cover 30 is longer than the length $l_2$ of the wooden post 100 (FIG. 2).

Figure 5:
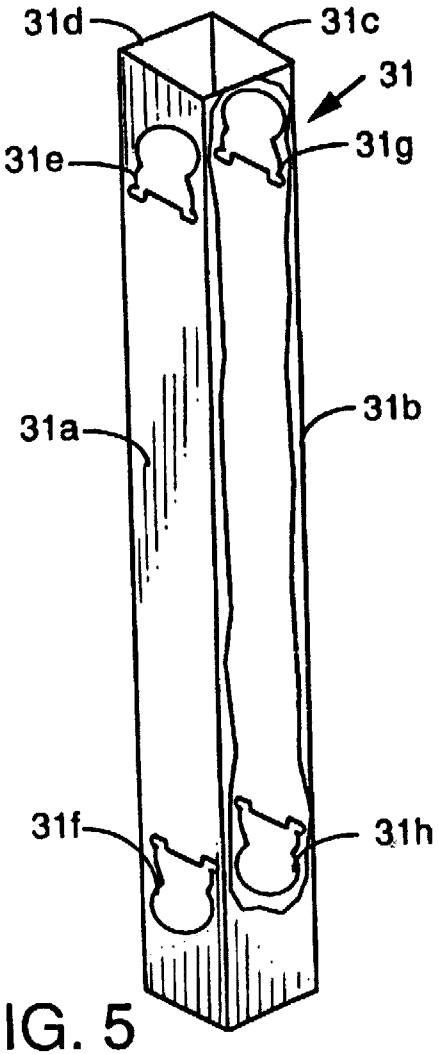
FIG. 5 is a perspective view of an in-line post cover.
Figure 4:
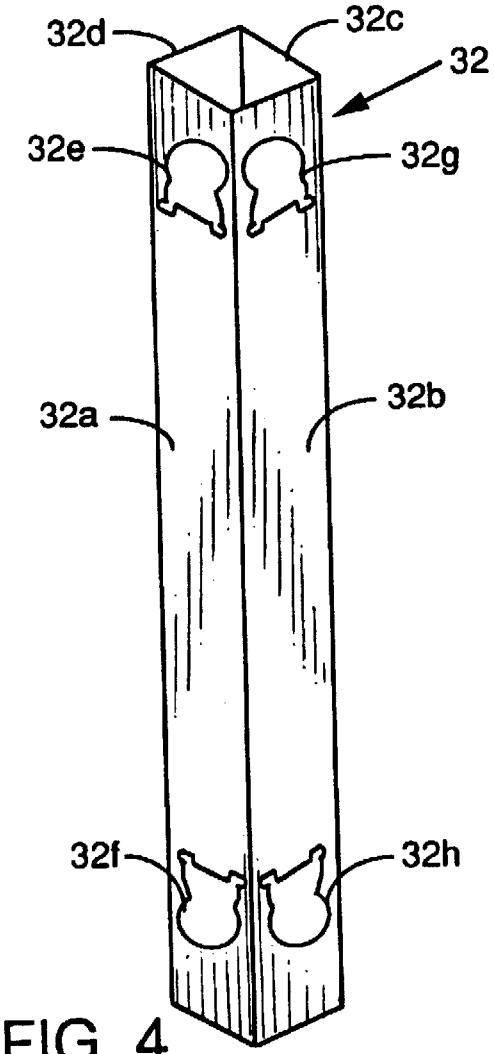
FIG. 4 is a perspective view, partially cutaway, of a corner post cover.

FIGS. 4 and 5 show the corner post cover 32 and an in-line post cover 31, respectively. The differences between the corner, in-line and end post are the position and arrangement of the railing holes. Referring to FIG. 4, corner post cover 32 has four walls 32*a*, 32*b*, 32*c* and 32*d* with rail holes 32*e* and 32*f* being defined by wall 32*a* and rail holes 32*g* and 32*h* being defined by wall 32*b*. This arrangement permits securement of upper rails 41, 42 and lower rails 46, 47 to the corner post cover 32 and the wooden post (not shown) that is covered by the corner post cover 32. The in-line post cover 31 has walls 31*a*, 31*b*, 31*c* and 31*d* with rail holes 31*e* and 31*f* defined by wall 31*a* and rail holes 31*g* and 31*h* defined by wall 31*c*. This arrangement permits securement of upper rails 40, 41 and lower rails 45, 46 to the in-line post cover 31 and the wooden post 130 (see FIGS. 2A and 2B) that is covered by the in-line post cover 31.

Figure 7:
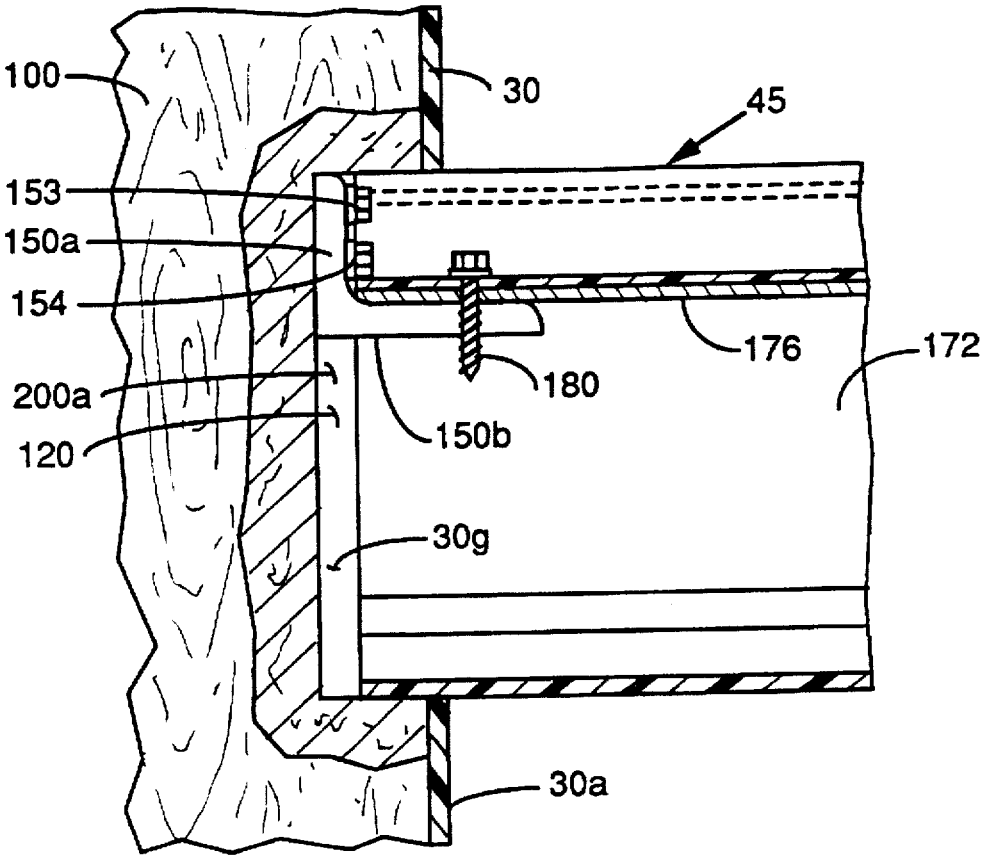
FIG. 7 is a side elevational view showing the lower rail being secured to the wooden post and end post cover.
Figure 8:
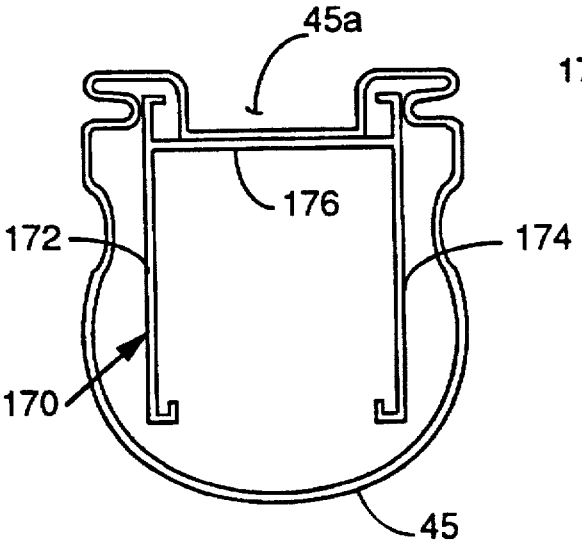
FIG. 8 is a vertical cross-sectional view taken through the bottom rail.

Referring back to FIG. 2 and to FIGS. 6–8, the installation of the rails will be discussed. As can be seen by FIG. 2, the wooden post 100 includes a notched area 120. This notched area 120 can be created in several ways, such as by cutting multiple relief lines into the post and then using a hammer and chisel to remove the cut portions. The notched area is slightly larger than rail hole 30*g* and in fact will be generally aligned with rail hole 30*g* in order to facilitate securement of the lower rail 45 to the wooden post 100 and end post cover 30.

Figure 2A:
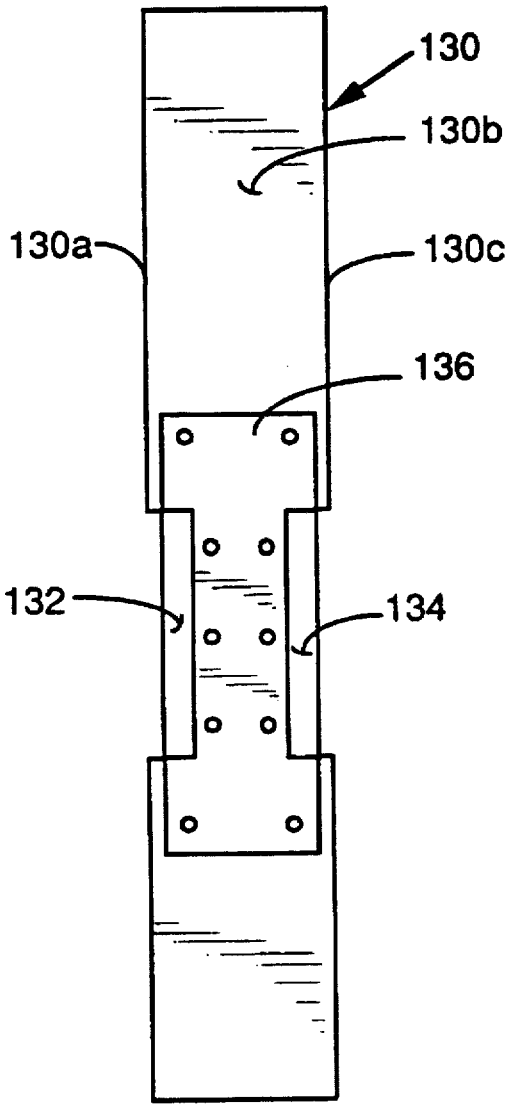
FIG. 2A is a front elevational view of an in-line wooden post.
Figure 2B:
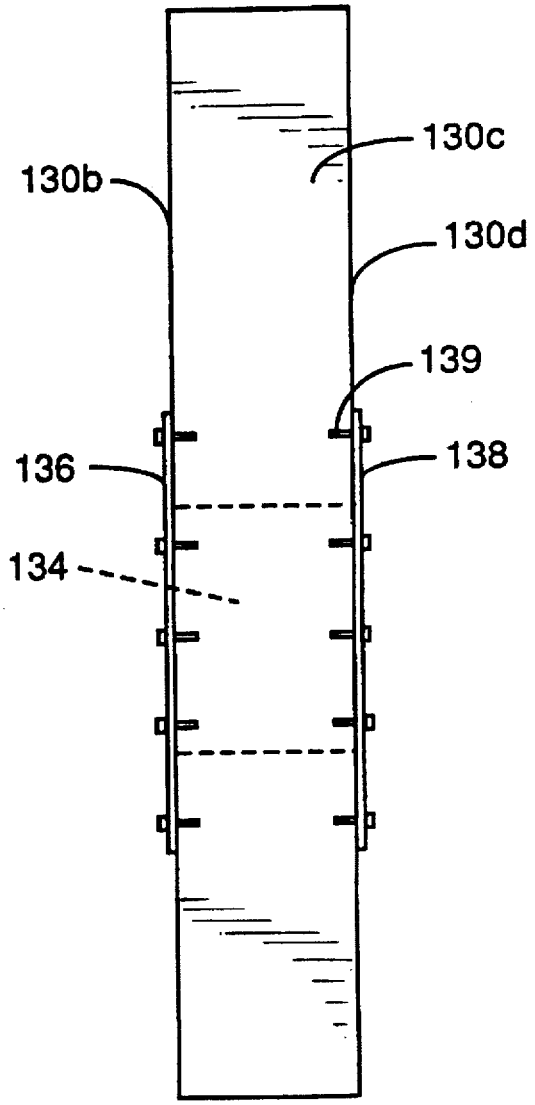
FIG. 2B is a side elevational view of the in-line wooden post shown in FIG. 2A.

Referring to FIGS. 2A and 2B, an in-line wooden post 130 which is to be covered by the in-line post cover 31 is shown. Post 130 has sides 130*a*, 130*b*, 130*c* and 130*d*. The wooden post 130 has two notches 132, 134 formed in sides 130*a* and 130*c* which will facilitate securing thereto the lower rails 45 and 46 respectively. In order to provide extra structural support to the in-line wooden post 130, it is preferred to provide a pair of galvanized steel plates 136, 138 secured to sides 130*b* and 130*d* of the post 130. The plates 136, 138 can be secured to the sides 130*b* and 130*d* of the post 130 by fastening means, such as nails or screws 139.

Figure 6:
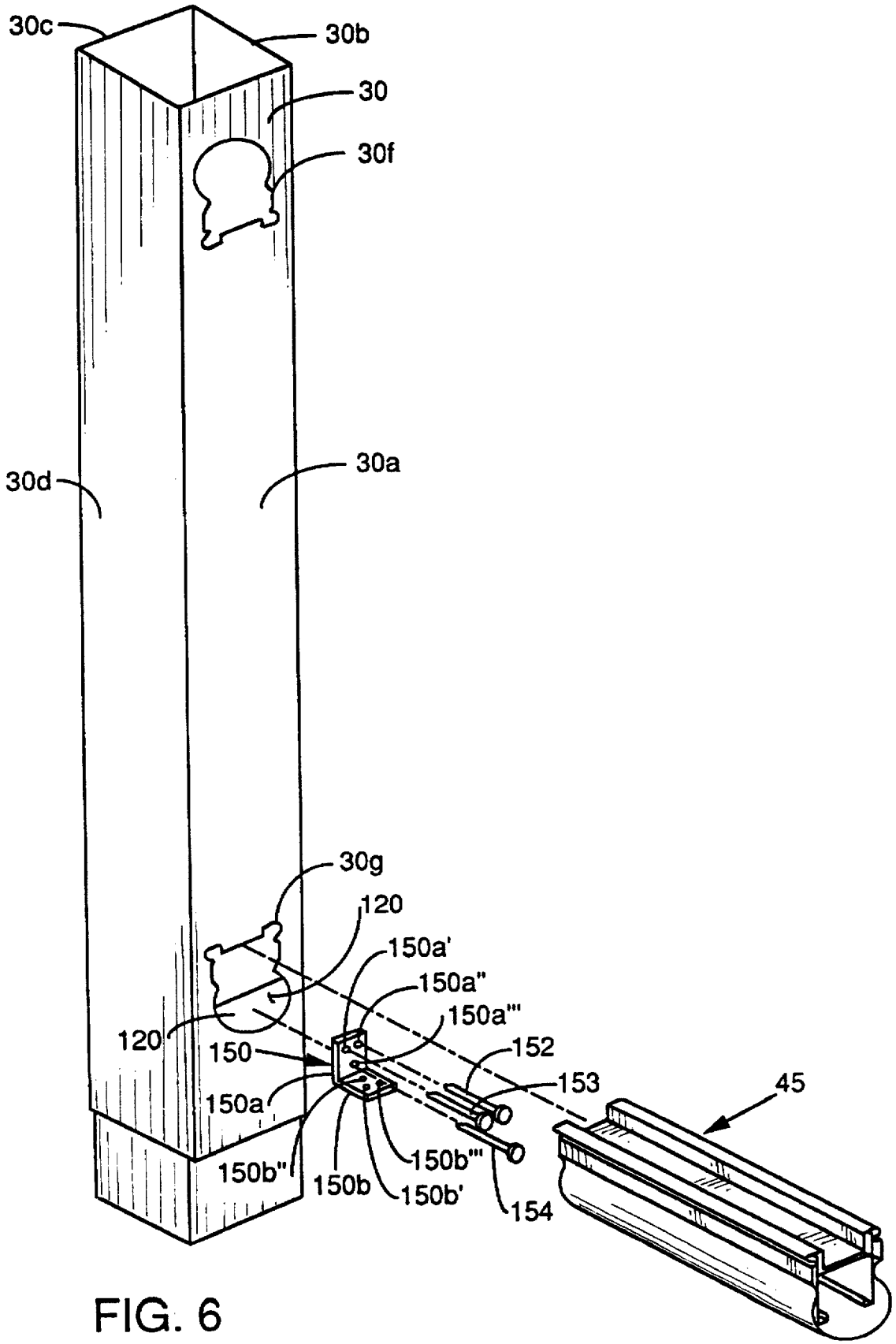
FIG. 6 is a perspective view showing the securement of the lower rail to the wooden post and end post cover by means of the fastener means.

Referring now to FIG. 6, the end post cover 30 is slid over top of the wooden post 100 which now has notched area 120. At this time, the end post cover 30 is moved up slightly, such as shown in FIG. 6, to reveal the top 120*a* of notched area 120. An L-shaped bracket 150 is provided which has a first portion 150*a* and a second portion 150*b*, with first portion 150*a* defining holes 150*a*', 150*a*" and 150*a*'" and with second portion defining holes 150*b*', 150*b*" and 150*b*'". The first portion 150*a* of the bracket 150 is secured to the top 120*a* of the notched area 120 with screws 152, 153 and 154. The second portion 150*b* extends from the wooden post 100 and the notched area 120 and thus can be attached to the rail 45. As can be seen in FIG. 8, the rail 45 is also a hollow extrusion having a channel 45*a* (whose purpose will be described more fully below) and which also includes a reinforcing member 170 which is, preferably, made of aluminum. The reinforcing member 170 gives strength to the railing and also facilitates making the railing assembly comply with applicable building codes. The reinforcing member 170, which is seen in cross-section in FIG. 8, extends longitudinally the entire length of the hollow rail extrusion 45 and is generally H-shaped in cross-section, having two vertical flanges 172, 174 and a connecting bridge flange 176.

Referring back to FIG. 7, the rail 45 and reinforcing member 170 are then engaged into the notched area with the reinforcing member 170 and channel portion 45*a* being positioned over second portion 150*b* of the L-shaped bracket 150. Screws such as screw 180 are then used to secure the rail 45 and reinforcing member 170 to the second portion 150*b* of the L-shaped bracket 150.

It will be appreciated that all lower rails 45–48 are secured similarly to each respective post and post cover. It will be appreciated that two notched areas are created on the wooden posts covered by in-line post covers 31 and 33, with the notched area being aligned with rail holes 31*f* and 31*h* of in-line post cover 31 and respective rail holes (not shown) of in-line post cover 33. In addition, two notched areas are created on the wooden post covered by corner post cover 32 with the notched areas being aligned with rail holes 32*f* and 32*h*.

Figure 9:
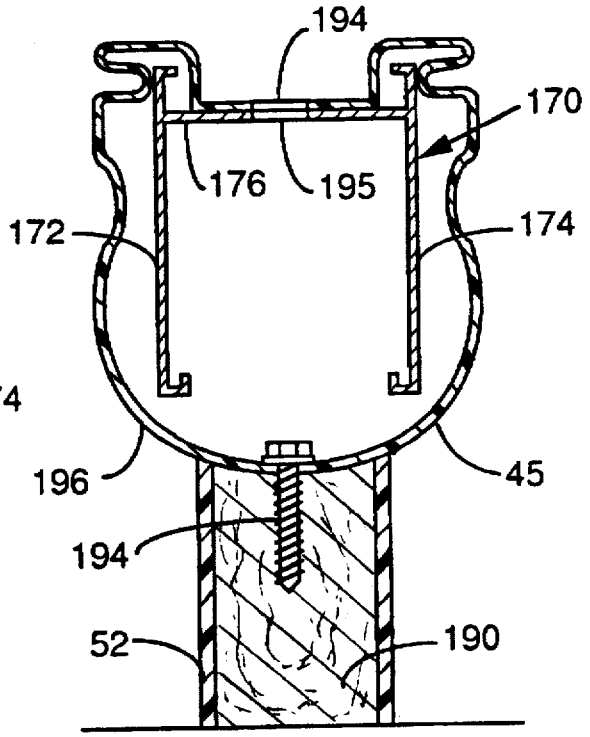
FIG. 9 is a vertical cross-sectional view of the center support secured to the lower rail.

Once the lower rails 45–48 are installed, the center supports 52–55 are installed. Referring to FIG. 9, the center support 52 includes a hollow extrusion that covers a piece of wood 190, the center support 52 is fastened to the lower rail 45 by a screw 192. A hole 194 is drilled through the rail extrusion 45 and a hole 195 is drilled through the reinforcing member 170 and the rail extrusion 45 and the bottom curved portion 196 of the rail extrusion 45 are secured by screw 192 to the wood load 190 which is covered by the center support extrusion 52. As mentioned above, the center support 52 is usually necessary for lower rails which extend more than five feet between posts.

Figure 10:
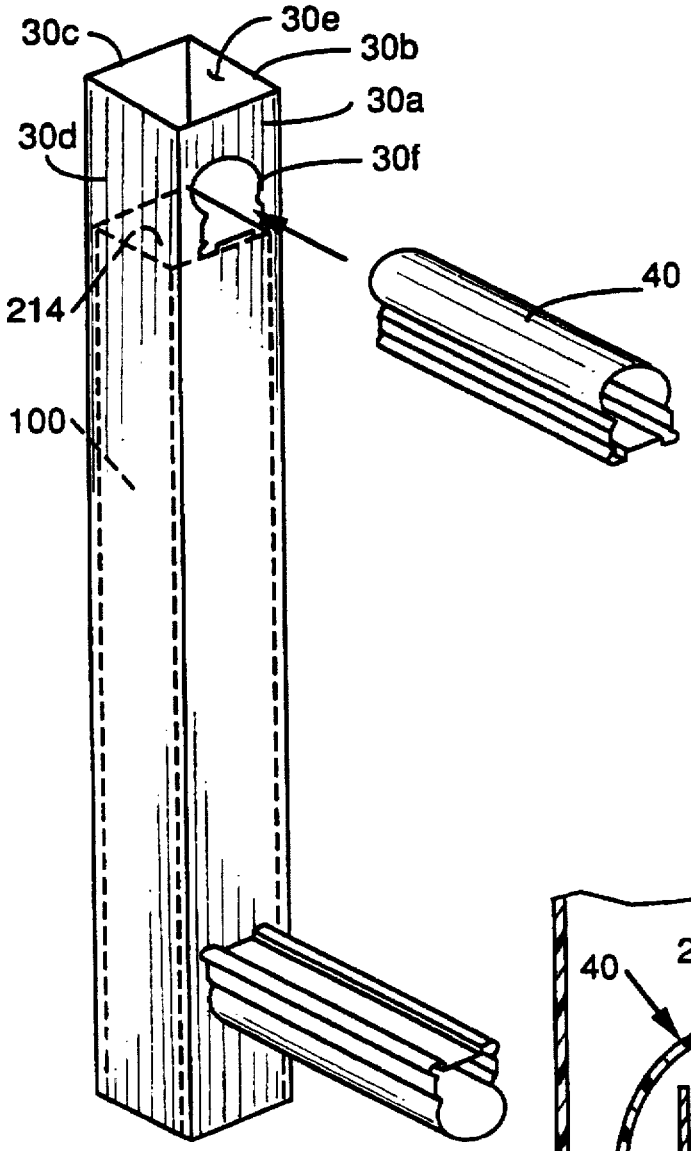
FIG. 10 is a perspective view showing the installation of the upper rail.
Figure 11:
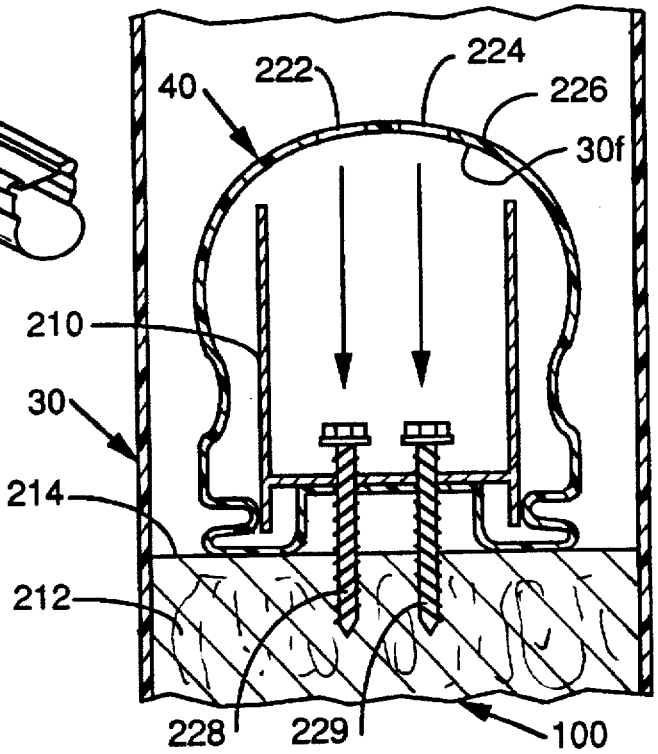
FIG. 11 is a vertical cross-sectional view of the upper rail secured to the top of the wooden post.

Referring now to FIGS. 10 and 11, the upper rail 40 installation will be described. The upper rail 40 is similar to the lower rail 45 in that it consists of a hollow extrusion which surrounds a reinforcing member 210. The upper rail 45 engages into rail hole 30*f* as shown in FIG. 10 and is then secured to the top portion 212 of wooden post 100 as shown in FIG. 11. Rail hole 30*f* is positioned such that it is above top surface 214 of wooden post 100. Referring to FIG. 11, two holes 222 and 224 are drilled into the curved portion 226 of upper rail 40 and screws 228 and 229 are placed through the holes 222 and 224, through reinforcing member 210 and rail 40 to be sunk into the wooden post 100.

It will be appreciated that the other upper rails are secured to the respective wooden posts as is shown in FIGS. 10 and 11. The upper rails are made so that they are slightly longer than the distance between the posts in order to facilitate engagement into the rail holes and subsequent securement of the rails to the wooden posts. It will be appreciated that the in-line posts, such as in-line post cover 31, receives the ends of two rails such as rail 40 and rail 41 and the corner post cover also receives the ends of two rails, such as rail 41 and rail 42. It will further be appreciated that the ends of rails 41 and 42 which engage into corner post cover 32 are mitred in order to fit in the space created above the wooden post (not shown) which is covered by corner post cover 32.

Figure 12:
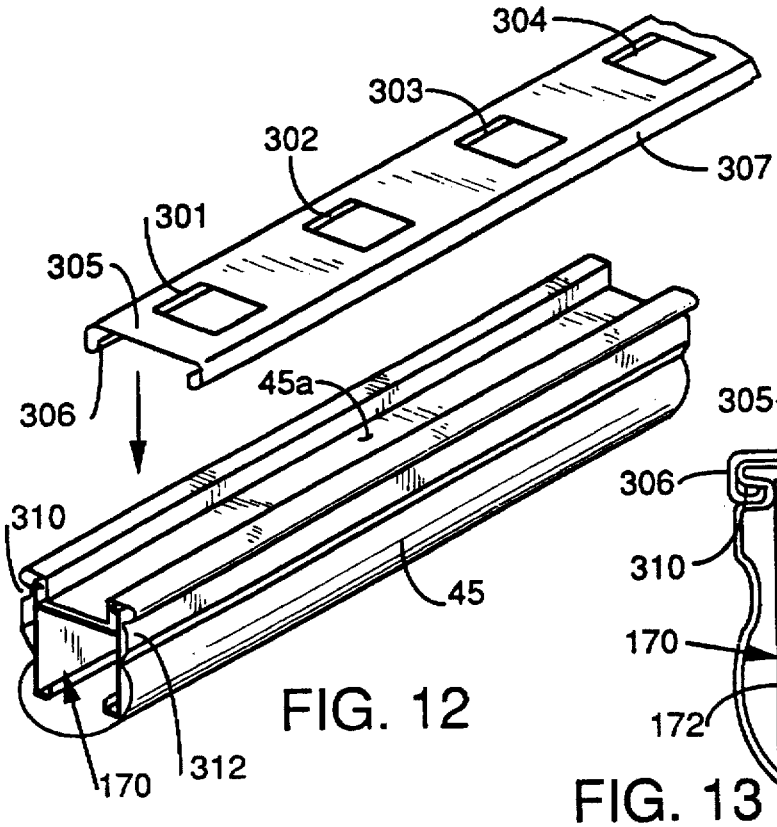
FIG. 12 is an exploded perspective view of the lower rail and the bottom picket cover.
Figure 13:
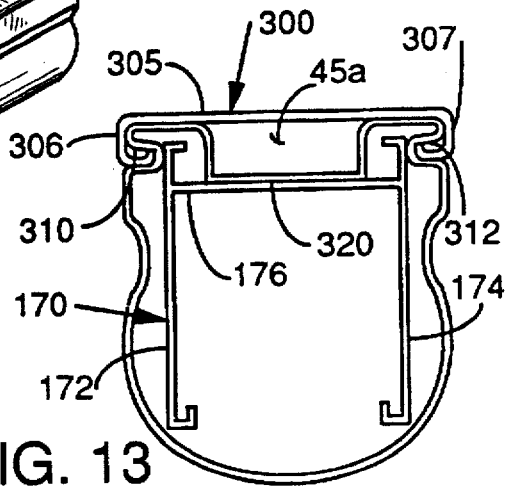
FIG. 13 is a vertical cross-sectional view of the bottom picket cover snapped onto the lower rail.

Once the upper and lower rails are secured, the final step of assembling the railing assembly 20 involves the installation of the pickets. Referring to FIGS. 12–22, the installation of the pickets will be discussed. FIG. 12 shows a perspective view of the lower rail 45 with the bottom picket cover 300. The bottom picket cover 300 is a plastic extrusion which are a plurality (four holes 301, 302, 303, 304 are shown) of picket cover holes defined therein. Referring particularly to FIG. 13, the bottom picket cover 300 includes a central portion 305 and two opposed flanges 306 and 307 which extend generally perpendicularly to the central portion 305. The bottom picket cover 300 is adapted to snap onto the lower rail 45 as is shown in FIG. 13 with flanges 306 and 307 of the picket cover 300 snapping into undercut spaces 310 and 312 formed in the rail 45. The bottom picket cover 300 and the top portion 320 of the bottom rail 45 form the channel portion 45*a*.

Figure 14:
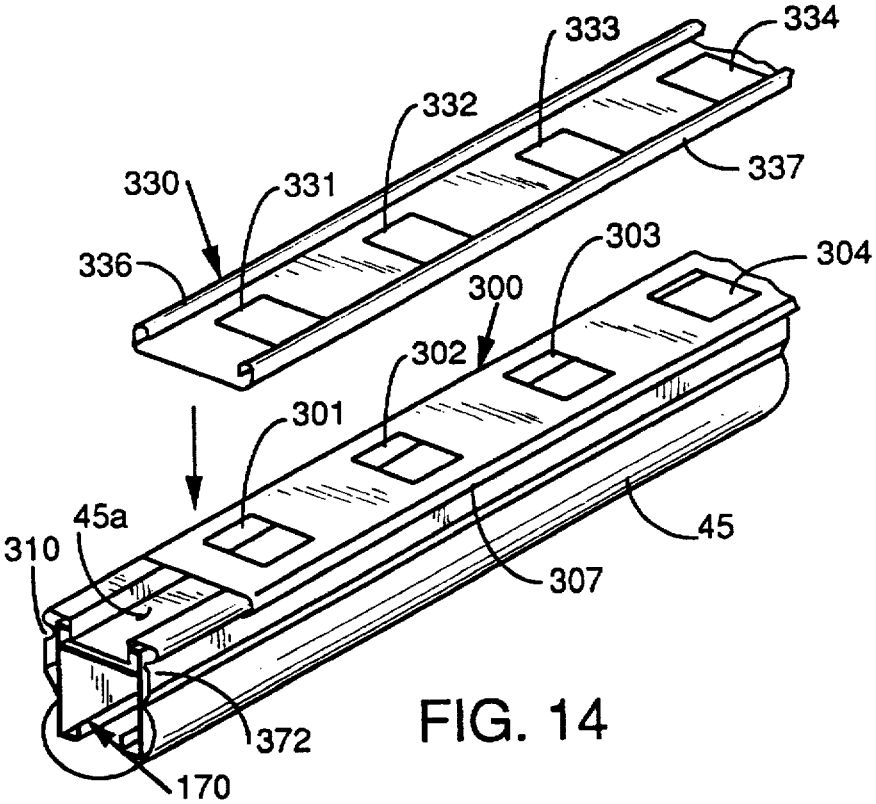
FIG. 14 is a perspective view similar to FIG. 12 only showing the bottom picket cover snapped onto the lower rail and the top picket cover.

Once the bottom picket cover 300 is snapped onto the bottom rail 45, a top picket cover 330 which is similar in structure to bottom picket cover 300, also including holes 331, 332, 333 and 334 is laid on top of the bottom picket cover 300 so that the holes 301, 302, 303 and 304 of the bottom picket cover 300 and the holes 331, 332, 333 and 334 of the top picket cover 330 are aligned as is shown in FIG. 14. The bottom picket cover 330 also includes a central portion 335 and two opposed flanges 336 and 337 which extend generally perpendicularly to the central portion 305.

Figure 15:
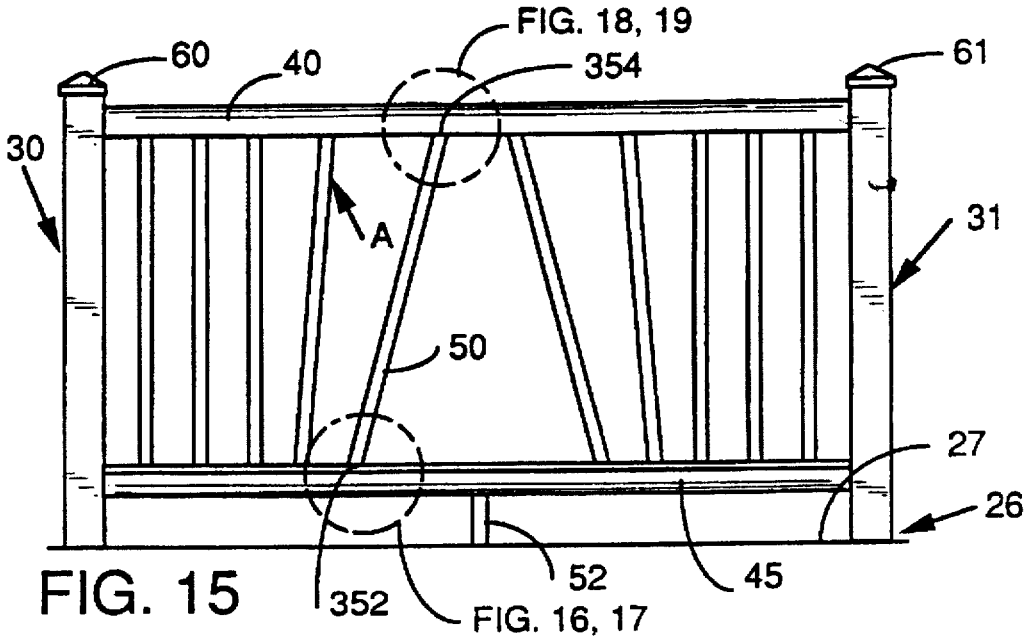
FIG. 15 is an elevational view of a section of the railing assembly showing how the pickets are secured between the upper rail and the lower rail.
Figure 16:
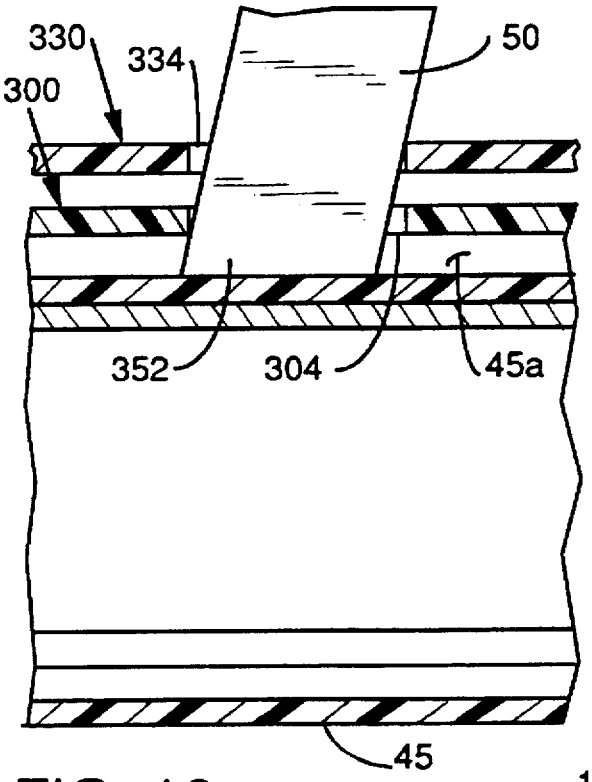
FIG. 16 is a cross-sectional view showing the detail of a portion of FIG. 15.
Figure 17:
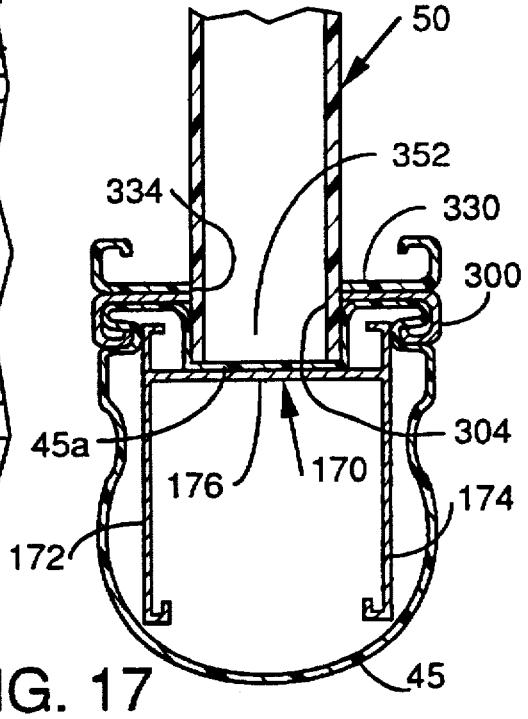
FIG. 17 is a vertical cross-sectional view of the detailed area of FIG. 15.
Figure 18:
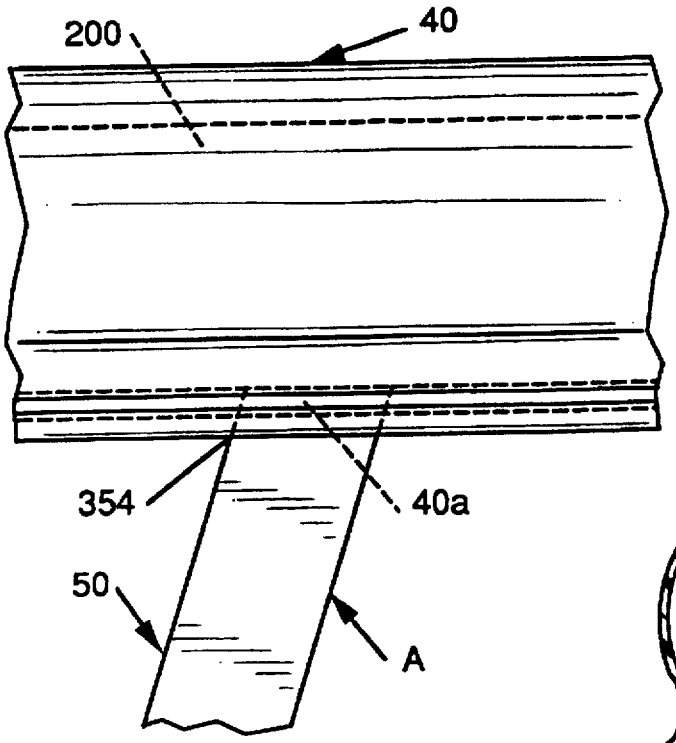
FIG. 18 is a detailed view of a portion of FIG. 15.
Figure 19:
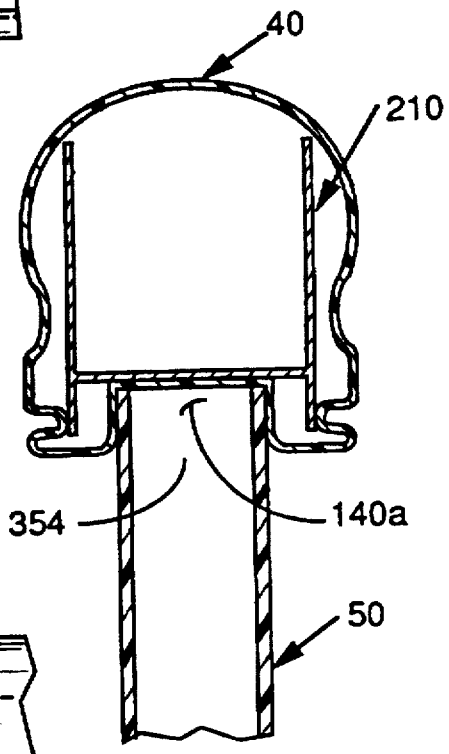
FIG. 19 is a vertical cross-sectional view of FIG. 18.
Figure 20:
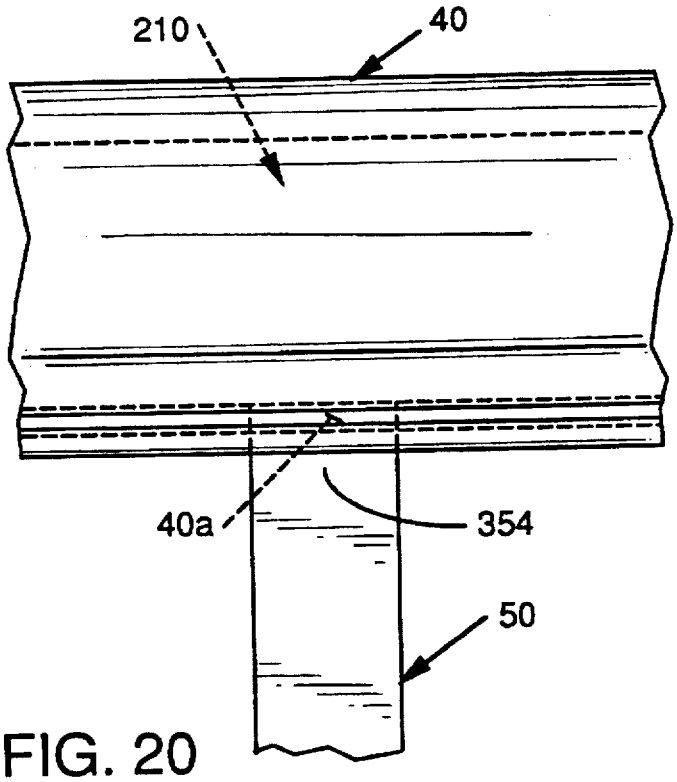
FIG. 20 is a view similar to FIG. 17 only showing the picket standing in an upright and secured position.
Figure 21:
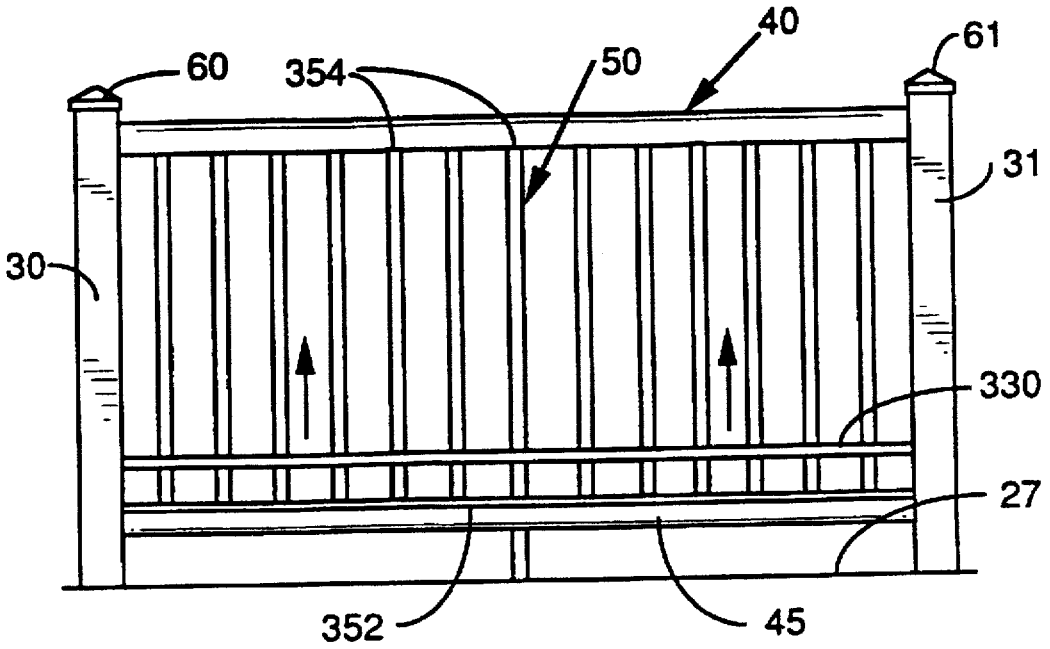
FIG. 21 is an elevational view, similar to FIG. 15, only showing all of the pickets in alignment with the top picket cover being slid up into position.
Figure 22:
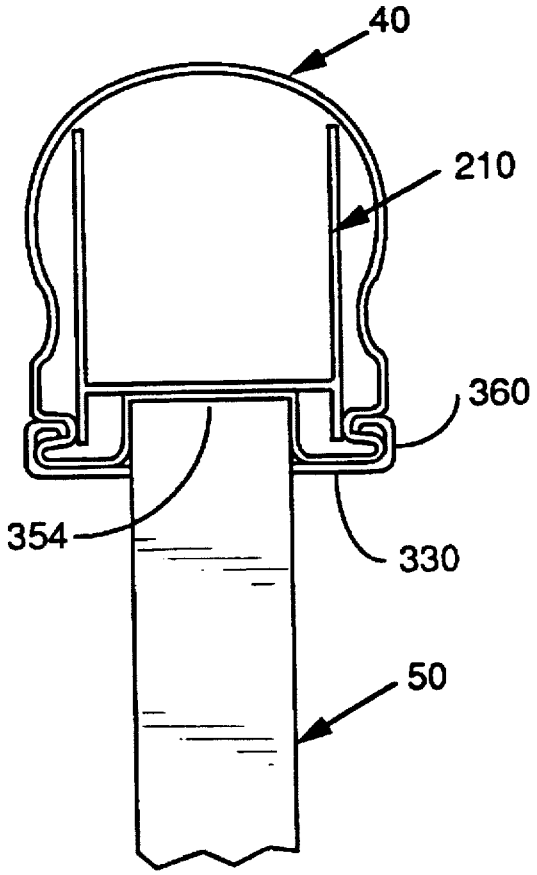
FIG. 22 is a detailed vertical cross-sectional view showing the top picket cover secured to the upper rail.

Referring now to FIGS. 15–18, the pickets are then installed between the upper rail 40 and the lower rail 45. It is preferred that the pickets nearest to the post covers 30 and 31 are installed first with the middle pickets, such as picket 50 being installed last. As can be seen by observing FIGS. 16 and 17 the picket, such as picket 50 has its bottom portion 352 placed through hole 334 of top picket cover 330 and hole 304 of bottom picket cover 300 (for example) and is secured into channel 45*a* of rail 45. This is accomplished by tilting the picket 50 as shown in FIGS. 15 and 16. Once the bottom portion 352 of the picket 50 is in place, the top portion 354 of the picket is moved to the upright position in the direction of arrow A on FIG. 15. The top portion 354 will engage into channel 40*a* (which is defined similarly as channel 45*a* of rail 45) defined by top rail 40 as is shown in FIGS. 18 and 19. Once all of the pickets are placed between the posts and are in an upright position as shown in FIG. 20, the top picket cover 330 is slid up the pickets as is shown in FIG. 21. As can be seen in FIG. 22, the top picket cover 330 is snapped onto the bottom portion 360 of the upper rail 40 similarly as the bottom picket cover 300 is snapped onto the bottom rail 45 (see FIGS. 12, 13 and 17) and the installation of the pickets is complete.

It will be appreciated that a railing assembly and an associated method has been provided that is made of plastic extrusions. The railing system is easy to install and maintain and complies with most building codes.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A deck assembly comprising:

a deck surface;

a first post extending vertically upwardly from said deck surface, said first post defining a notched area;

a first plastic post cover for substantially covering said first post; a first plastic rail extending from said first plastic post cover; and mechanical fastening means having a first section thereof secured to said first post which defines a portion of said notched area and a second section of said mechanical fastening means secured to said first plastic rail.

2. The assembly of claim 1, wherein said first plastic post cover defines a first opening into which said first plastic rail engages.

3. The assembly of claim 1, wherein said mechanical fastening means is an L-shaped bracket.

4. The assembly of claim 1, wherein said first plastic rail includes a hollow first plastic extrusion and a first reinforcing member disposed in said first hollow plastic extrusion.

5. The assembly of claim 1, including a first generally vertically oriented picket spaced from said first post and secured to said first plastic rail.

6. The assembly of claim 5, wherein said first plastic rail defines a first channel;

a first picket cover secured to said first plastic rail, said first picket cover defining a first picket opening; and a first end portion of said first picket engaging into said first picket opening and disposed in said first channel, whereby said first picket is secured to said first plastic rail.

7. The assembly of claim 6, including a second plastic rail disposed in spaced, generally parallel relationship to said first plastic rail; and said first picket extending between said first plastic rail and said second plastic rail.

8. The assembly of claim 7, wherein said second plastic rail defines a second channel;

a second picket cover secured to said second plastic rail, said second picket cover defining a second picket opening; and a second end portion of said first picket opposite said first end portion of said first picket engaging into said second picket opening and disposed in said second channel of said second plastic rail, whereby said first picket is secured to said second plastic rail.

9. The assembly of claim 8, including a plurality of pickets extending between said first plastic rail and said second plastic rail.

10. The assembly of claim 9, including said second plastic rail includes a second hollow plastic extrusion and a second reinforcing member disposed in said second hollow plastic extrusion.

11. The assembly of claim 1, including a second post extending from said deck surface, said second post being spaced apart from said first post;

a second plastic post cover for covering said second post; and said first plastic rail extending between said first post and said second post.

12. The assembly of claim 11, wherein said first post and said second post each including aligned, opposed notched areas; and a first of said mechanical fastening means being disposed in said notched area of said first post and a second of said mechanical fastening means being disposed in said notched area of said second post.

13. The assembly of claim 1, wherein said first plastic post cover defines an opening into which said first plastic rail engages;

said first post includes a top surface; and said opening is positioned such that said first plastic rail can be secured to said top surface of said first post.

14. A method of providing a deck comprising:

providing a deck surface and a first post extending from said deck surface, said first post defining a notched area;

providing a first plastic post cover and a first plastic rail;

covering said first post with said first plastic post cover; and securing said first plastic rail to a portion of said first post which defines said notched area with a mechanical fastening means.

15. The method of claim 14, including providing a picket; and securing said picket to said first plastic rail.

16. The method of claim 15, including providing a second plastic rail; and securing said picket to said second plastic rail.

17. The method of claim 14, including providing a second post extending from said deck surface;

providing a second plastic post cover;

covering said second post with said second post cover; and securing said first plastic rail to said second post and said second post cover.

* * * * *